US009840878B2

(12) United States Patent
Martin et al.

(10) Patent No.: US 9,840,878 B2
(45) Date of Patent: Dec. 12, 2017

(54) CONNECTOR APPARATUS

(71) Applicant: SCHLUMBERGER TECHNOLOGY CORPORATION, Sugar Land, TX (US)

(72) Inventors: David Glen Martin, Keith (GB); William Luke McElligott, Exeter (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/820,656

(22) Filed: Aug. 7, 2015

(65) Prior Publication Data

US 2016/0047177 A1 Feb. 18, 2016

(30) Foreign Application Priority Data

Aug. 12, 2014 (GB) ..... GB1414308.5
Sep. 12, 2014 (GB) ..... GB1416187.1

(51) Int. Cl.
*E21B 19/16* (2006.01)
*E21B 43/10* (2006.01)
*E21B 17/04* (2006.01)

(52) U.S. Cl.
CPC ..... *E21B 17/04* (2013.01); *E21B 19/16* (2013.01); *E21B 43/106* (2013.01); *E21B 43/108* (2013.01)

(58) Field of Classification Search
CPC ..... E21B 17/04; E21B 19/16; E21B 43/106; E21B 43/108
See application file for complete search history.

(56) References Cited

U.S. PATENT DOCUMENTS 3,710,864 A * 1/1973 Mitchell ..... E21B 29/10 166/242.6
4,593,448 A * 6/1986 Ferrari Aggradi ..... B21D 39/04 138/147
4,662,663 A * 5/1987 Schmitz ..... B21D 39/04 285/382.5
4,925,220 A * 5/1990 Szymczak ..... B21D 39/04 285/331
5,010,952 A * 4/1991 Chin ..... E21B 33/04 166/206
5,829,524 A * 11/1998 Flanders ..... E21B 17/08 166/242.7
7,017,670 B2 * 3/2006 Hazel ..... E21B 29/10 166/147
2007/0257486 A1 * 11/2007 Filippov ..... E21B 43/106 285/382.2

(Continued)

OTHER PUBLICATIONS

EPO As International Search Authority, International Search Report and Written Opinion for PCT/GB2015/052244, dated Nov. 10, 2015, entire document.

*Primary Examiner* — Matthew R Buck

(57) ABSTRACT

Apparatus and method for sealingly connecting tubular members in a wellbore. In an arrangement where a portion of a tubular member is radially expanded into sealing contact within a second tubular member, and the second tubular member has circumferential recesses on an inner surface, a resilient member protrudes from a side wall of the recesses. The resilient member is acted on by the portion of the tubular member during expansion and maintains sealing contact to the portion after expansion.

20 Claims, 6 Drawing Sheets

(56) References Cited

U.S. PATENT DOCUMENTS

| | | | | |
|---|---|---|---|---|
| 2010/0052319 | A1* | 3/2010 | Benzie | F16L 15/04 285/382.2 |
| 2010/0078178 | A1 | 4/2010 | Watson | |
| 2012/0227984 | A1* | 9/2012 | Thomson | E21B 43/108 166/380 |
| 2014/0000911 | A1* | 1/2014 | Gorrara | E21B 43/106 166/380 |
| 2014/0008082 | A1* | 1/2014 | O'Brien | E21B 19/16 166/380 |

* cited by examiner

CONNECTOR APPARATUS

The present invention provides an apparatus and a method for connecting tubular members in a wellbore and in particular provides an apparatus and a method for sealing and/or securing a first (inner) tubular to a second (outer) tubular in a wellbore and thereby providing an annular seal between the first and second tubular members.

In wellbore drilling and completion, various tubular elements (also typically referred to in the industry as "tubulars") need to be connected to each other. For example, in well completions, a number of tubulars may have to be connected end to end in order to form a string of tubulars such as a casing string or liner string to line the wellbore to the required depth. In some cases, one tubular has to be set inside another tubular by increasing the diameter of the inner tubular until it contacts the inner wall of the outer tubular and creates an interference fit therewith. The connection between the tubulars very often must be capable of withstanding axial loads (i.e. secured). The connection should also be fluid tight to provide an annular barrier between the tubulars (i.e. sealed) to prevent fluid passage between the internal bore of the outer tubular and the exterior of the inner tubular.

One prior art arrangement for connecting tubular members in a wellbore is described in WO2011/048426 A2 and includes a metal to metal seal between first and second tubular members A, B in a cased wellbore, as shown in FIGS. 1 and 2 of the present application. The second (lower) tubular member B includes an upper end portion C which has a greater inner diameter than the outer diameter of a lower end portion D of the first (upper) tubular member A. Circumferential recesses or grooves E are formed on the inner surface or bore of the upper end portion C of the second (lower) tubular member B. In order to form the seal, firstly, the lower end portion D of the first tubular member A is located within the upper end portion C of the second tubular member B. Next, a hydraulic expansion tool F is lowered from surface inside the first tubular member A to the intended location of the seal (see FIG. 2 of the present application). The tool F seals off a chamber G between a pair of axially spaced apart seals H. Actuation of the hydraulic expansion tool F causes chamber G to be filled with fluid under high pressure, and this high pressure fluid acts on the inner surface or bore of the lower end portion D of the first tubular member A to first elastically and then plastically expand so that the lower end portion D expands radially outwardly along a length bounded by the seals H into the recesses E on the inner bore of the second tubular member B such that circumferential protrusions I or ridges are formed on the outside of the lower end portion D of the first tubular portion A. These protrusions I are received in the recesses E until a seal is formed between the first and second tubular members A, B.

In this way, a liner tieback is formed. A similar technique is used to connect an overshot device with a tubular downhole, e.g. casing or liner, in fishing operations, to engage an inner bore surface of the overshot device with the outer surface of the tubular, to allow jarring and retrieval of the tubular. This technique also provides a casing reconnect.

A known problem associated with the above described arrangement is that well fluid present at the interface between the tubular members A, B may become trapped in the recesses E which can lead to the formation of hydraulic lock which is potentially damaging to the tubular members. Additionally, when the pressure used to morph the first tubular member A to the second tubular member B is released, the trapped fluid pressure within the recesses E may cause separation of the members A, B causing the metal to metal seal created at the contact point 3 (see FIG. 3) to be lost as the first member A is forced away from the second member B.

It is an object of the present invention to provide a connector apparatus for sealingly connecting to a tubular member in a wellbore which obviates or mitigates at least some of the disadvantages of the prior art.

According to a first aspect of the invention there is provided a connector apparatus for sealingly connecting to a tubular member in a wellbore, the connector apparatus comprising:

a substantially cylindrical body having a receiving section adapted to receive therein at least one portion of the tubular member for permitting expansion of the said at least one portion radially outwardly against one or more circumferential recesses on an inner surface of the receiving section until one or more joints are formed between the said at least one portion and the receiving section; wherein, a resilient member protrudes from a side wall of at least one of said recesses, the resilient member being acted on by the at least one portion during expansion and maintaining sealing contact to the at least one portion after expansion.

In this way, when the pressure is released after expansion of the tubular member, the resilient member will move with the tubular member to ensure a seal is maintained between the connector apparatus and the tubular member.

Preferably, the resilient member is entirely contained within the recess. In this way, the resilient member does not interfere with the tubular member being located in the receiving section.

Preferably, there are two resilient members, oppositely arranged across the recess, each protruding from an opposing side wall. In this way, a seal is maintained at either side of the recess.

Preferably, the resilient member is an annular ring and is coaxial with the circumferentially arranged recess. In this way, a seal is maintained around the entire circumference of the connector apparatus.

Preferably, the resilient member has an upper surface and a lower surface, the lower surface facing a base of the recess. In this way, the lower surface provides a surface for the trapped pressure to act against and help maintain the seal.

Preferably, the resilient member includes a spur, located on the upper surface. More preferably the spur extends circumferentially around the resilient member. In this way, point contact is achieved with the tubular member.

In an embodiment, the resilient member is formed integrally with the receiving section. In this way, the resilient member can be machined in the receiving section when the recess is machined.

In a further embodiment, the resilient member is a metal ring located within the recess. In this way, resilient members can be added when required and the complexity and cost of machining the receiving section. Preferably, the metal ring includes a support base, the base having a height substantially the same as the height of the side wall of the recess. In this way, the metal ring is supported in the recess and the position of the protruding resilient member is fixed relative to the base of the recess.

Preferably, a plurality of recesses is linearly arranged along the inner surface of the receiving section and at least one recess includes at least one resilient member. More preferably, a recess includes two opposing resilient members. Alternatively, there are a pair of neighbouring recesses with a resilient member on each side wall of the adjoining rim between the recesses.

A resilient member may be located on a common side wall of a plurality of the recesses. In this way, a unidirectional seal is provided along the connector apparatus at multiple unidirectional sealing points. Such a unidirectional arrangement allows any pressure build up between resilient members facing the same direction to be expelled as the upper resilient members flex outwards to let the pressurised fluid out.

In an embodiment, there are a pair of neighbouring recesses with a resilient member on each side wall of the adjoining rim between the grooves, with at least one recess to the right including a resilient member on its left side wall and at least one recess to the left including a resilient member on its right side wall. In this way, pressure can be expelled through the opposing directed resilient members away from the centre rim.

Preferably, where a recess includes one resilient member the opposing side wall has a radius with the inner surface of the tubular member.

Preferably, the resilient member is formed of metal so that a metal to metal seal is formed.

Preferably, the one or more created joints are either sealed or secured connections or, more preferably, are both sealed and secured joints. The so formed joint created between the connector apparatus and the tubular member has the ability to withstand axial loads and fluid pressures acting between the connector apparatus and the tubular member. The joint preferably creates both a mechanical fixing between the two tubular members and also a hermetic seal between the connector apparatus and the tubular member. Preferably, the joint is formed as a result of initially elastic and then plastic deformation of the material of at least the said at least one portion and, preferably also the receiving section of the connector apparatus.

The outward expansion may be achieved, for example, by application of radial outward pressure or force to side walls of the said at least one portion of the tubular member within an inner bore of the said at least one portion.

In an embodiment, a fluid exclusion device is located in one or more recesses. The fluid exclusion device may be provided having an annular configuration, e.g. in the form of a ring. The fluid exclusion device may comprise a fluid exclusion material, which may comprise a crushable medium, such as, for example closed cell foam, such as, for example, metal foam or syntactic foam, placed in the recess in order to prevent fluid from filling the recess but being collapsible under the pressure of the at least one portion so as to allow a protrusion of the at least one portion to enter the recess. The fluid exclusion device is also preferably capable of taking in some fluid whilst being collapsed thereby further minimising the risk of occurrence of a hydraulic lock. Such fluid may be present about the fluid exclusion device prior to the fluid exclusion device being collapsed or may be displaced towards the fluid exclusion device during expansion of the said at least one portion of the tubular member. Alternatively or additionally, the fluid exclusion device comprises a collapsible ring, such as, for example, a hollow ring, in the or each recess, the ring being configured to collapse when the ring experiences certain pressure. The collapsible ring works in a manner similar to the fluid exclusion foam, i.e. by preventing fluid from entering the recess when the ring is intact whilst collapsing under the force of the circumferential protrusion of the said at least one portion of the second tubular member. A collapsible ring can function at higher temperatures and pressures than those withstandable by foam. Also, an appropriately selected collapsible ring may be capable of accommodating greater fluid volume than foam.

In a further embodiment, a port may be located through the base of one or more recesses. The port provides a fluid exit path to relieve pressure from within the recess during morphing by evacuating it to the outside of the connector apparatus.

Optionally, one or more rims between adjacent recesses may include a bypass channel. The bypass channel advantageously allows fluid under pressure to travel from one recess to a neighbouring recess. The bypass channel may be a slot machined on the surface of the rim. A fluid bypass channel may also be located along the inner surface of a distal recess to allow fluid to escape from an end of the connector apparatus. In this way hydraulic lock is prevented.

The said at least one portion of the tubular member can be expanded by an appropriate tool, such as for example a conventional prior art hydraulic expansion tool, a cone displacement tool, rollers, or any other tool capable of increasing the inner diameter of the said at least one portion.

The connector apparatus could be any sort of tubing used downhole, for example, an overshot device for fishing operations, or indeed casing, liner, tieback liner or production tubing, etc. which needs to be fitted over an outer surface of another smaller diameter tubing for example, as a liner tieback or casing reconnect.

Similarly, the tubular member can comprise any sort of tubing, tubular, conduit or pipe used downhole e.g. liner for a liner tieback and casing for a casing reconnect.

According to a second aspect of the invention there is provided a method of connecting tubular members in a wellbore, the method comprising the steps of:

a) providing a connector apparatus according to the first aspect;

b) placing the said at least one portion within the receiving section of the connector apparatus;

c) expanding the said at least one portion radially outwardly against the receiving section until one or more joints are formed between the said at least one portion and the receiving section;

d) acting on the resilient member by the at least one portion during expansion; and e) acting on the at least one portion by the resilient member following expansion to maintain sealing contact between the resilient member and the at least one portion after expansion.

In this way, when the pressure is released after expansion of the tubular member, the resilient member will move with the tubular member to ensure a seal is maintained between the connector apparatus and the tubular member.

Preferably, the method includes the step of using trapped fluid pressure to act upon a lower surface of the resilient member to assist in maintaining sealing contact between the resilient member and the at least one portion after expansion.

Preferably, the method includes the step of providing multiple unidirectional sealing points along the connector apparatus.

Preferably, the method includes the step of directing pressurised fluid out the at least one recess. This step may be by directing fluid through a port in the recess to the outside of the connector apparatus. Alternatively or additionally the step may be by directing fluid between neighbouring recesses.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof. All positional terms such as 'up' and 'down', 'left' and 'right' are relative and apply equally in opposite and in any direction.

Embodiments of the present invention will now be described, by way of example only, with reference to the accompanying drawings in which.

Figure 4:
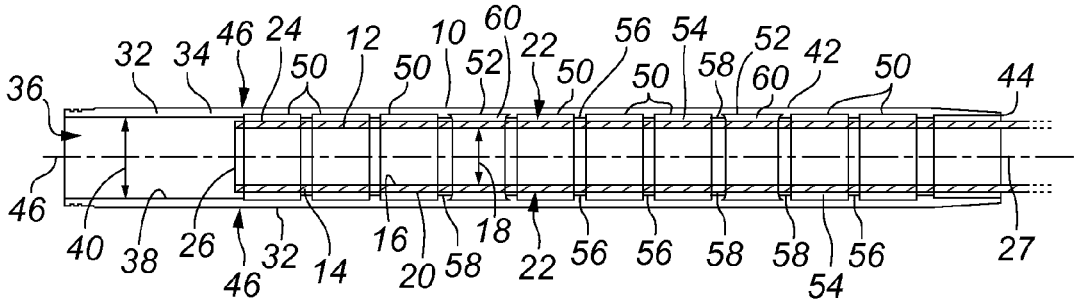
FIG. 4 is a schematic illustration of a sectional side view of an arrangement for connecting tubular members according to an embodiment of the present invention.

Referring initially to FIG. 4 there is provided a connector apparatus generally indicated by reference numeral 10 for providing a sealed connection to a first tubular member 12 according to an embodiment of the present invention.

The first tubular member 12 has a substantially cylindrical body having a bore 14 therethrough providing an inner surface 16 with a first diameter 18 and an outer surface 10 with a second diameter 22 along the majority of its length (not shown). The first tubular member 12 is of metal construction and has dimensions typical of tubulars round in the oil and gas industry as used in tubing strings, casings and liners. The first tubular member 12 has a first end 24 with an annular end face 26 which is substantially perpendicular to the longitudinal axis of the bore 27.

In this embodiment, a second tubular member 32 has a substantially cylindrical body 34 having a bore 36 therethrough providing an inner surface 38 with an inner diameter 40 along the majority of its length (not shown). The inner diameter 40 is the narrowest section of the tubular member 32. The second tubular member body 34 is of metal construction and has dimensions typical of tubulars round in the oil and gas industry as used in tubing strings, casings and liners. The second tubular member 32 has a first end 42 with an annular face 44 which is substantially perpendicular to the longitudinal axis 46 of the bore 36.

Figure 5:
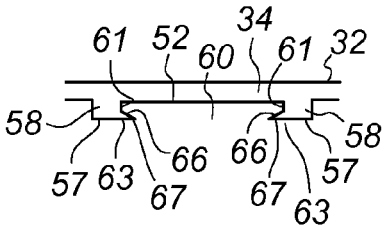
FIGS. 5 and 6 are schematic illustrations of a sectional side view of details of a connecting apparatus of an arrangement of FIG. 4.

The connector apparatus 10 is integrally formed with, and will be described with reference to, a first end 42 of the second tubular member 32. On the inner surface 38 of the length of connector apparatus arranged at the first end 42 of the second tubular member 32 there is provided a series of profiled sections 50 and 52. Each profiled section 50 and 52 is a shape machined into the inner surface 38. The shape of each of 50 and 52 are each entirely circumferential in that, a cross sectional view, as shown in FIG. 5 for profiled section 50 and 52 for every cross-section around the tubular 32.

Profile section 50 provides circumferential groove 54. The grooves 54 are rectangular cut outs forming a complete annular ring. The grooves 54, when formed adjacent one another, are equidistantly spaced with a rim 56, which has a rectangular profiled, is located between the grooves 54. The rim 56 may be considered as a circumferential band, bead or protrusion facing the bore 34. While three adjacent grooves 54 are arranged adjacent one another in the present embodiment, it will be understood that any number of grooves may be arranged adjacent one another in this arrangement. In this embodiment, a width of each groove 54 is greater than a corresponding width of each rim 56 although any relationship can be used.

Profile section 52 provides circumferential groove 60 which forms a complete annular ring. The groove 60 is undercut into the body 34 of second tubular 32 to create recesses 61 such that the distal end 57 of each rim 58, which is formed adjacent groove 60 is provided with a projection, or lug 63. Each lug 63 extends from rim 58 toward the opposing lug 63 in parallel to the longitudinal axis of the bore 36. In this embodiment, a width of each groove 60 is greater than a corresponding width of each rim 58 and projection 63 although any relationship can be used.

Figure 6:
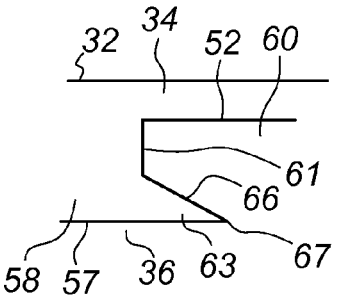

In FIG. 6, a portion of a profiled section 52 and rim 58 is shown in more detail. The recess 61 is formed by undercutting the body 34 of the inner surface 38 below thus leaving projection 63 at the distal end 57 of rim 58 where it extends in parallel to the longitudinal axis of bore 36. The projection 63 is machined in such a way that the underside surface 66 tapered towards the inner surface 38 of the bore 36 as the lug progresses in its projection to form the distal end 67 of the lug 63 and is formed so as to be operable to act as a resilient member which can be elastically deformed upon application of radial pressure. Distal end 67 may be rounded.

In use, the first end 24 of the first tubular member 12 is inserted into the first end 42 of the second tubular member 32 until the annular end face 26 of the first end 24 extends beyond the profiled sections 50, 52 of connector apparatus 10 such that the profiled sections 50, 52 are co-axially arranged around the outer surface 20 of the first tubular member 12. This arrangement is shown in FIG. 4. A metal to metal seal is created between the outer surface 20 of the first end 24 of the first tubular member 12 and the profiled sections 50 of the connector apparatus 10 arranged at the first end 42 of the second tubular member 32. This is achieved by applying force to the inner surface 16 at the first end 24 of the tubular member 12.

The seal may be created by use of a hydraulic tool (not shown). A detailed description of the operation of such a hydraulic tool is described in GB2398312 in relation to the packer too 112 shown in FIG. 27 of GB2398312 with suitable modifications thereto, where the seal means 92 could be provided by suitably modified seal assemblies 214, 215 of GB2398312, the disclosure of which is incorporated herein by reference. The entire disclosure of GB 2398312 is incorporated herein by reference.

Figure 1:
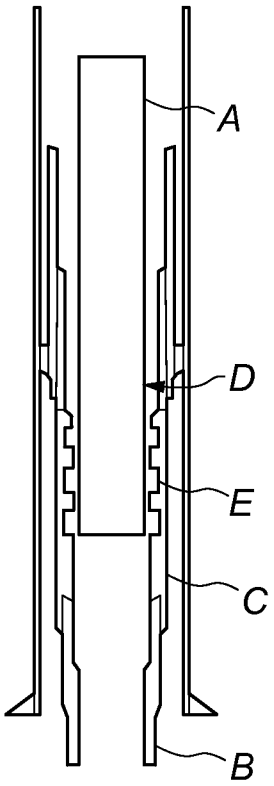
Fig. 1 (PRIOR ART)
FIGS. 1 and 2 are sectional side views of stages of a prior art method of connecting tubular members and therefore do not form part of the present invention.
Figure 2:
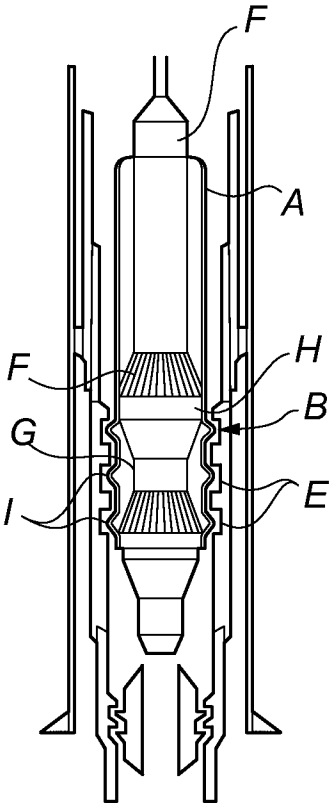
Fig. 2 (PRIOR ART)
Figure 3:
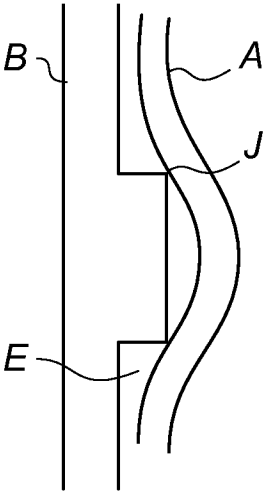
Fig. 3 (PRIOR ART)
FIG. 3 is an exploded view of part of the sectional side view of the connection in FIG. 2 and therefore does not form part of the present invention.

The tool is inserted into the tubulars 12, 32 and located within the bore 27 of the first tubular member 12. Elastomeric seals (not shown) are arranged on the tool to straddle the grooves 50, 52 and lie over the inner surface 16 of the tubular member 12. When in position, the elastomeric seals are energised so that they expand radially outwardly and create a seal between the outer surface of the tool body and the inner surface 16 of the first tubular member 12. With the seals energised, a chamber is created which is bounded by the outer surface of the tool, the inner surface 16 and the elastomeric seals. Hydraulic fluid is then pumped through the tool body so that it exits a port and enters the chamber. Once the chamber is filled, continued pumping forces the outer surface 20 of the first end 24 of the tubular member 12 to move radially outwardly by the use of fluid pressure acting directly on the inner surface 16 between the elastomeric seals. Sufficient hydraulic fluid pressure is applied to move the outer surface 20 of the first end 14 of the tubular member 12 radially outwards and cause the tubular member 12 to morph itself onto the inner surface 38 of the first end 42 of the second tubular member 32. This is as per the prior art described with reference to FIGS. 1 and 2.

Figure 7:
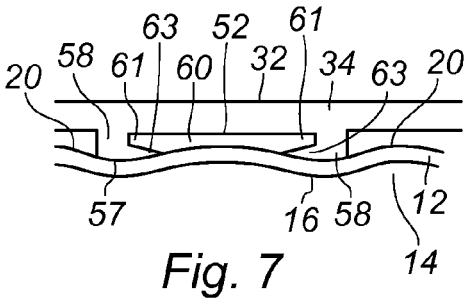
FIG. 7 is a schematic illustration of a sectional side view of a detail of the arrangement for connecting tubular members of FIG. 4.

During the morphing process, the first tubular member 12 will undergo elastic expansion filling, or at least partially filing the grooves 50, 52. The lugs 63 will be acted upon by the outer surface of the morphing first tubular 12 and will deflect inward towards the recess 52 within their elastic limit giving an improved metal to metal sealing contact between the lugs 63 and the outer surface 20 as is shown in FIG. 7 with no intermediary connector member required. Continued expansion will cause the tubular member 12 to undergo plastic deformation. Sufficient pressure may be applied to also cause the first end 42 of the second tubular member 32 to elastically deform. When the pressure is released the first end 42 will return to its original dimensions and create a seal against the deformed end 24 of the tubular member 12. Similarly, upon release of the hydraulic fluid pressure if any reduction in expanded dimensions of inner tubular 12 occurs, the deflected lugs 63 will also spring back maintaining a sealing contact pressure.

During the morphing process, the outer surface 20 of the end 24 of the first tubular member 12 will take up the shape of the inner surface 38 of the first end 40 of the second tubular member 32. A metal to metal seal is preferentially achieved between the first tubular member 12 and the second tubular member 32 at the edges of the grooves 50, 52. At each groove 50, there are two points for a seal, so for several grooves there are multiple sealing points. At each groove 52, the lugs 63 provide an extended surface area over which a resilient seal occurs as well as the points at the distal ends 67 around which the tubular member 12 bends when it is morphed into groove 52. The grooves 50, 52 provide for vertical loading when the tubular members 12, 32 are arranged for insertion into the well bore (not shown) should assembly of the tubulars 12, 32 occur prior to insertion into a well bore. The lugs 63 at grooves 52 also provide for improved continued sealing being achieved should axial loading occur at the joint. Once the connector apparatus 10 has been activated, the resilient seal provided by the lugs 63 protruding in an opposing direction maintains a seal at either side of the recess 50 which is maintained around the entire circumference of the connector apparatus 10. Furthermore, should any fluid have become trapped in recess 52 during the morphing process then, upon release of the hydraulic morphing pressure, residual trapped fluid pressure will act upon the underside 66 of the lug 63 thus helping to maintain the metal to metal contact seal.

With the joint between the first tubular member 12 and the second tubular member 32 made, the elastomeric seals on the tool are de-energised so that they come away from the surface 20. The tool can then be removed from the tubular members 12, 32.

Figure 8:
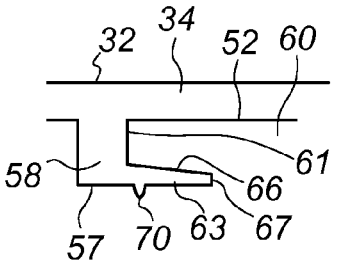
FIG. 8 is a schematic illustration of a sectional side view of a detail of an arrangement for connecting tubular members according to another embodiment of the present invention.

In FIG. 8, a detail of connector apparatus 10 is shown according to another embodiment of the present invention. The resilient seal lug 63 is shown to be provided with a projection, or spur, 70 which extends circumferentially around the resilient member 63. In use, as morphing hydraulic pressure is applied to first tubular member 12, the spur 70 acts as a point contact around which the outer surface 20 of the first tubular member 12 can deform thus enhancing the resilient seal achieved.

Figure 9:
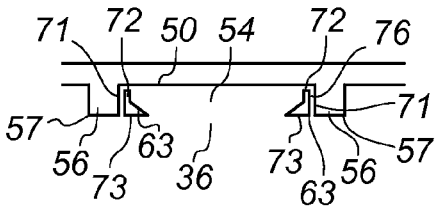
FIG. 9 is a schematic illustration of a sectional side view of a detail of an arrangement for connecting tubular members according to another embodiment of the present invention.

In FIG. 9, a detail of connector apparatus 10 is shown according to another embodiment of the present invention. The body 34 of second tubular member 32 has circumferential groove 54 milled to form a complete annular ring having a profile section 50. The section 50 has sides 71 milled perpendicularly to the longitudinal axis 46 of the bore 36. Resilient seal members 72 are ring members, formed of metal construction, which are located in recess 50 such that the upper surface 73 of lugs 63 is in parallel with rim surfaces 57. The resilient seal member 72 is formed of metal and is provided with a side support 76 which, in use abuts against side 71 of profile section 50 and enables the protruding lug 63 to be held in position within the recess 50. The resilient seal 72 can be further provided with a base (not shown) which lies in parallel along the base 77 of the recess 50 and connects to the opposing resilient seal 72 to further facilitate the positioning of the resilient seal members within the recess 50. In use, the resilient seal will be actuated such that the lugs 63 elastically deform to provide an enhanced seal as previously described above.

Figure 10:
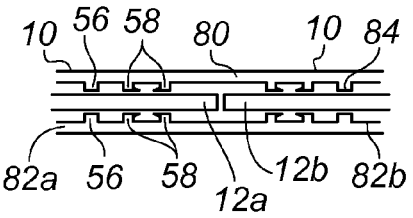
FIG. 10 is a schematic illustration of a sectional side view of a detail of an arrangement for connecting tubular members according to another embodiment of the present invention.

FIG. 10 illustrates an embodiment of the present invention wherein the first end 24*a* of a first tubular member 12*a* and the first end 24*b* of another first tubular member 12*b*, are each inserted into opposing ends 82*a*, 82*b* respectively of a connection tubular member 80 wherein each end 82*a*, 82*b* of the tubular member 80 is provided with connector apparatus 10. The connection tubular member 80 is a dual coupling system for connecting tubular members 12*a*, 12*b*. Connection tubular member 80 can, advantageously be of a shorter length that tubular members 12*a*, 12*b* so that it is easier to machine the profiled sections 50 and, if included, 52, on the inner surface 84 thereof. The connector 80 may also be formed of a different material to tubular members 12*a*, 12*b* which can resist the outwardly applied radial force better than the material of the tubular members 12*a*, 12*b*.

Figure 11:
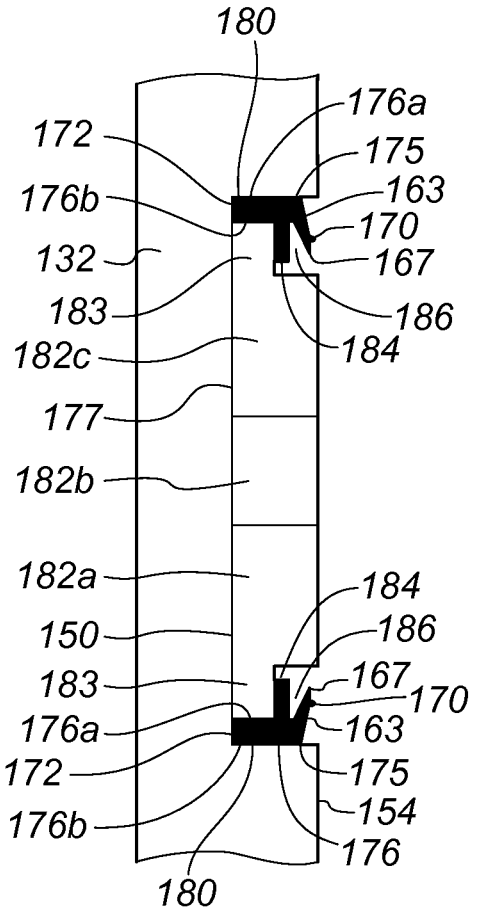
FIGS. 11 and 12 are schematic illustrations of a sectional side view of a detail of an arrangement for connecting tubular members according to another embodiment of the present invention.
Figure 12:
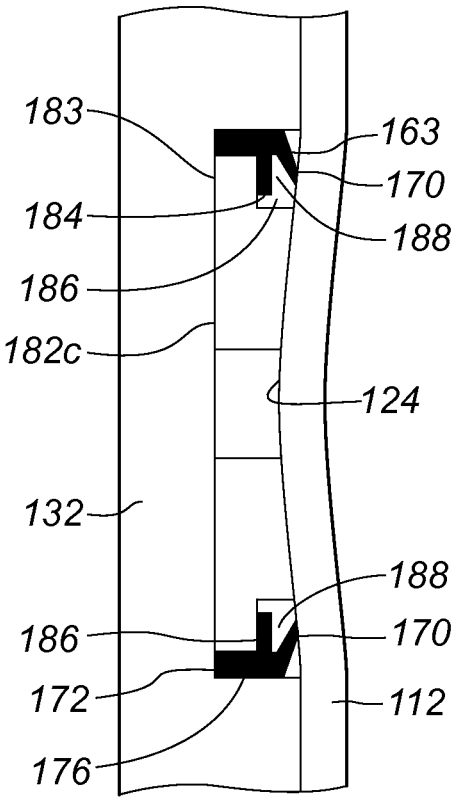

Reference is now made to FIGS. 11 and 12 of the drawings which illustrates a detail of the connector apparatus, generally indicated by reference numeral 110, for providing a connection between a first tubular member 112 and a second tubular member 132 according to another embodiment of the present invention. Like parts to those of FIGS. 4 to 10 have been given the same reference numerals with the addition of '100' to aid clarity. FIG. 11 shows a details of connector apparatus 110 for forming a metal to metal coupling between a first tubular member 112 and a second tubular member 114, similar to the coupling arrangement of FIG. 4, wherein the first tubular member is inserted into the second tubular member 132 end 146 at which connector apparatus 110 is located such that it is able to be connected as is shown in FIG. 12.

In the embodiment of FIG. 11, the second tubular member 132 is provided with grooves 150 having rims 154 therebetween with one groove 150 between two rims 154 shown. The depth of groove 150 is approximately half the thickness of the wall 133 of the second tubular member 132. The side walls 171 of groove 150 and resilient seal member 180 are inserted into groove 150 along with fluid exclusion means 182.

The resilient seal member 180, formed of a metallic material, each comprises a support 176, one face 176*a* of which is suitable to abut in parallel against recess wall 171. From support face 176*b*, two lugs project: lug 163 which juts from the distal end 175 of the seal member 180, and lug 184 which projects from around the midpoint of faced 176*b*. Lug 163 tapers from the point of projection to the distal tip 167 of the lug 163. The upper surface 173 of lug 163 is angled slightly away from recess 152 without projecting beyond rim 154 into bore 146. A spur 170 extends from the upper surface 173 of resilient seal member 180 and the projection 170 will act as a metal seal ring in use as described with reference to the metal seal ring 70 of FIG. 8.

Lug 184 projects into recess 150 and is used to hold the fluid exclusion means 182 in position. The recess 150 is further provided with fluid exclusion means 182. Fluid exclusion means are operable to exclude fluid from the interface between groove 150 and the outer surface 124 of first tubular 112 to minimize the occurrence of a hydraulic lock during the morphing process. In the presently described embodiment, the fluid exclusion means 182 comprises three fluid exclusion rings 182*a, b, c* each of which can be made of a fluid exclusion material, for example closed cell foam such as metal foam or syntactic foam although it will be appreciated that other suitable materials may be used.

Fluid exclusion ring 182*b* is an annular ring with a substantially rectangular or square profile. Fluid exclusion rings 182*a, c* each have a substantially rectangular profile which is provided with a lug projection 183*a, c* respectively which extends outwards from the ring 182*a, c*. The fluid exclusion rings 182*a, b, c* are placed in the recess 150 with ring 182*b* placed centrally and rings 182*a, c* placed on either side of ring 182*b* such that lug projections 183*a, c* extend in opposing directions towards the walls 171 of recess 150 such that the projections 183*a, c* are retained in placed within recess 159 below lugs 184 and a void 186 is created between lugs 163, 184 and fluid exclusion means 182.

The rings 182*a, b, c* may be made of the same, or of differing, fluid exclusion materials. The fluid exclusion rings 182*a, b, c* are placed in the recess 150 between resilient seal members 180 in order to prevent fluid from entering the recess 150. The fluid exclusion rings 182*a, b, c* are crushable or collapsible under external pressure. The fluid exclusion rings are preferably capable of taking in some fluid whilst being collapsed thereby further minimising the risk of occurrence of a hydraulic lock. Such fluid may be present around the fluid exclusion rings 182*a, b, c* prior to being collapsed or may be displaced towards the fluid exclusion rings 182*a, b, c* during expansion of the first tubular member 112. However, fluid 188 may be present in voids 186 during the morphing process.

In use the lugs 163 provide an extended surface area over which a resilient seal occurs as well as the points at the distal ends 67 around which the tubular member 112 bends when it is morphed into groove 150. Once the connector apparatus 110 has been activated, the resilient seal provided by the lugs 163 protruding in an opposing direction maintains a seal at either side of the recess 150 which is maintained around the entire circumference of the connector apparatus 110. Furthermore, the fluid 188, having become trapped in void 186 during the morphing process is subject to fluid pressure and, upon release of the hydraulic morphing pressure, will act upon the underside 166 of the lug 163 thus helping to maintain the metal to metal contact seal.

The connection joint formed between the first tubular member 112 and second tubular member 132 by connector arrangement 110 has the ability to withstand axial loads and fluid pressures acting between the first tubular member 112 and the second tubular member 132. The joint creates both a mechanical fixing between the two tubular members 112, 132 and a hermetic seal between the tubular members 112, 132.

In use, the first end 124 of the first tubular member 112 is inserted into the first end 142 of the second tubular member 132 until the annular end face 126 of the first end 124 extends beyond the profiled sections 150 of connector apparatus. A metal to metal seal is created between the outer surface 120 of the first end 124 of the first tubular member 112 and the profiled sections 150 and resilient members 180 of the connector apparatus 10 arranged at the first end 142 of the second tubular member 132. This is achieved by applying force to the inner surface 16 at the first end 24 of the tubular member 12 using a hydraulic tool as is described above.

Figure 13:
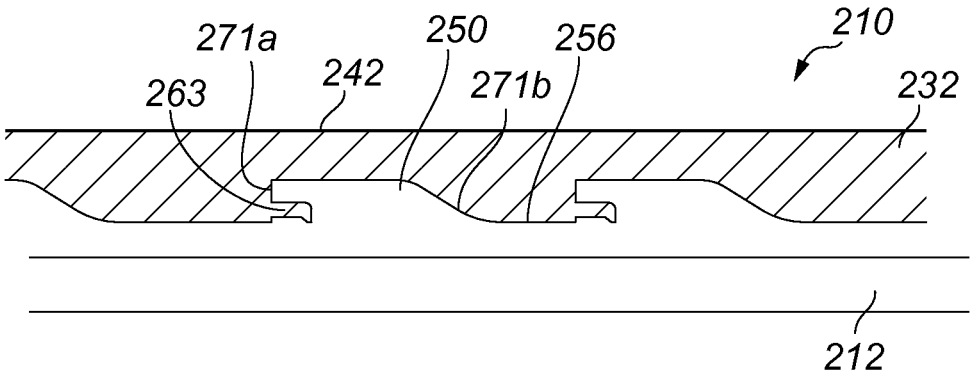
FIGS. 13 and 14 are schematic illustrations of a sectional side view of a detail of an arrangement for connecting tubular members according to another embodiment of the present invention.
Figure 14:
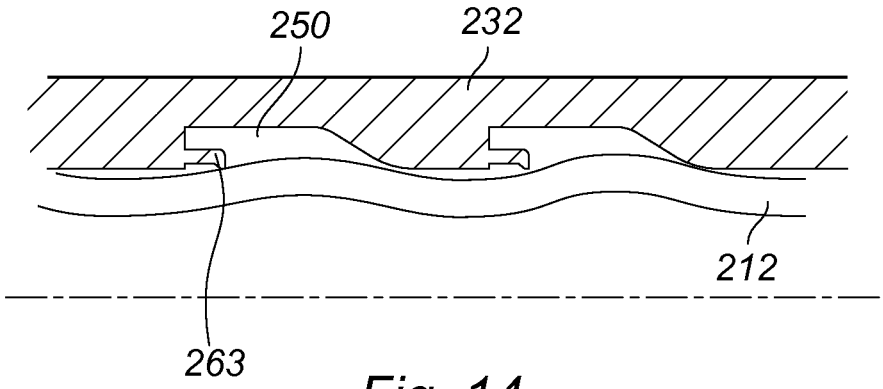

Reference is now made to FIGS. 13 and 14 of the drawings which illustrates a detail of the connector apparatus, generally indicated by reference numeral 210, for providing a connection between a first tubular member 212 and a second tubular member 232 according to another embodiment of the present invention. Like parts to those of FIGS. 4 to 10 have been given the same reference numerals with the addition of '200' to aid clarity.

FIG. 13 shows a details of connector apparatus 210 for forming a metal to metal coupling between a first tubular member 212 and a second tubular member 232, similar to the coupling arrangement of FIG. 4, wherein the first tubular member is inserted into the second tubular member end 242 at which connector apparatus 210 is located such that it is able to be connected as is shown in FIG. 14.

In the embodiment of FIG. 13, the second tubular member 232 is provided with grooves 250 having rims 256 therebetween. The side wall 271*a* on the right hand or upper side of groove 250 includes a resilient seal member 263 as described hereinbefore with reference to FIGS. 4 to 10. This provides a set of resilient seal members 263 all facing the same direction, that is, towards the left or downwards. The opposing side wall 171*b* is rounded being provided with a radius to meet the rim 256.

When the first tubular member 212 and a second tubular member 232 are morphed together as described hereinbefore and shown in FIG. 14, each resilient seal member 263 provides a sealing point between the tubular members 212, 232. The radius provides a sealing section at each groove and assists in pushing fluid under the resilient member 263 to thereby maintain the sealing point contact when the morphing pressure is released.

Figure 15:
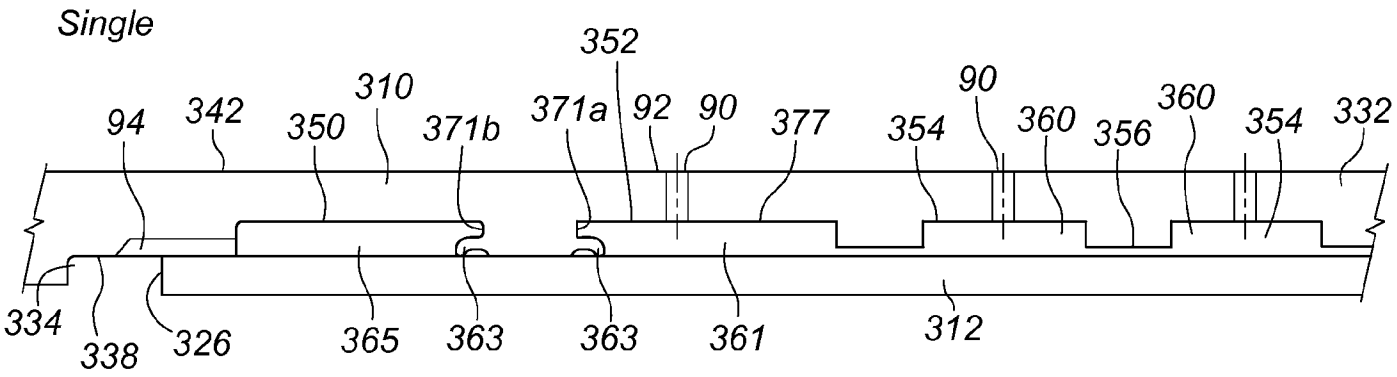
FIG. 15 is a schematic illustration of a sectional side view of a detail of an arrangement for connecting tubular members according to another embodiment of the present invention.

A further embodiment of a connector apparatus 310 is shown in FIG. 15. Connector apparatus 310 is integrally formed with, and will be described with reference to, a first end 342 of the second tubular member 332. Like parts to those of FIGS. 4 to 10 have been given the same reference numerals with the addition of '300' to aid clarity.

On the inner surface 338 of the length of connector apparatus 310 arranged at the first end 342 of the second tubular member 332 there is provided a series of profiled sections 350, 352, 354. Each profiled section 350, 352, 354 is a shape machined into the inner surface 338. The shape of each of 350, 352, 354 are each entirely circumferential in that, a cross sectional view, as shown in FIG. 15 for profiled section 350, 352, 354 for every cross-section around the tubular 332.

Profiled sections 354 provide circumferential grooves 360. The grooves 360 are rectangular cut outs forming a complete annular ring. The grooves 360, when formed adjacent one another, are equidistantly spaced with a rim 356, which has a rectangular profiled, is located between the grooves 360. The rim 356 may be considered as a circumferential band, bead or protrusion facing the bore. While two adjacent grooves 360 are arranged adjacent one another in the present embodiment, it will be understood that any number of grooves may be arranged adjacent one another in this arrangement. In this embodiment, a width of each groove 360 is greater than a corresponding width of each rim 356 although any relationship can be used.

Profile sections 352, 354 provide circumferential grooves 361, 365 which form complete annular rings. The grooves 361, 365 both include a single resilient member or lug 363. Lug 363 is described hereinbefore with reference to FIGS. 4-13. Each lug 363 is arranged on opposing side walls 371*b*, 371*a* of the rim 356 located between the grooves 361, 365. As such the lugs 363 each provide a unidirectional seal but in opposite directions. This gives bi-directional metal to metal sealing to the connection.

Grooves 360, 361 also include a port 90 being an aperture between the base 377 of the groove 360, 361 and the outer surface 92 of the second tubular member 332. Groove 365 includes a slot 94 along the inner surface 338 connecting the groove 365 with the bore above the upper end 326 of the first tubular member 312.

In use, first tubular member 312 is inserted within the connector apparatus 310 of second tubular member 332 to form a casing reconnect or liner tieback, for example. The upper end 326 of the first tubular member 312 is positioned at the slot 94. The first tubular member 312 is morphed against the inner surface 338 of the second tubular member 332 so that it enters the grooves 360, 361, 365 making metal to metal sealing contact with the edges of the rims 356 and the lugs 363. Fluid trapped in the grooves 360, 361 is forced out of the ports 90 so as to allow the first tubular member 312 to enter the grooves 360, 361 without risk of hydraulic lock. Fluid within groove 365 is forced through the slot 94 into the bore of the tubular members 312, 332. When the morphing pressure is released the lugs 363 will by their resilient nature bend inwards to maintain sealing contact with the first tubular member 312. The morphed connection can bear axial loading due to the corrugation of the first tubular member 312 into the grooves 360, 361, 365 of the second tubular member 332. It is noted that this connection is achieved without requiring the use of a fluid exclusion means such as syntactic foam in the grooves 360, 361, 365.

Figure 16:
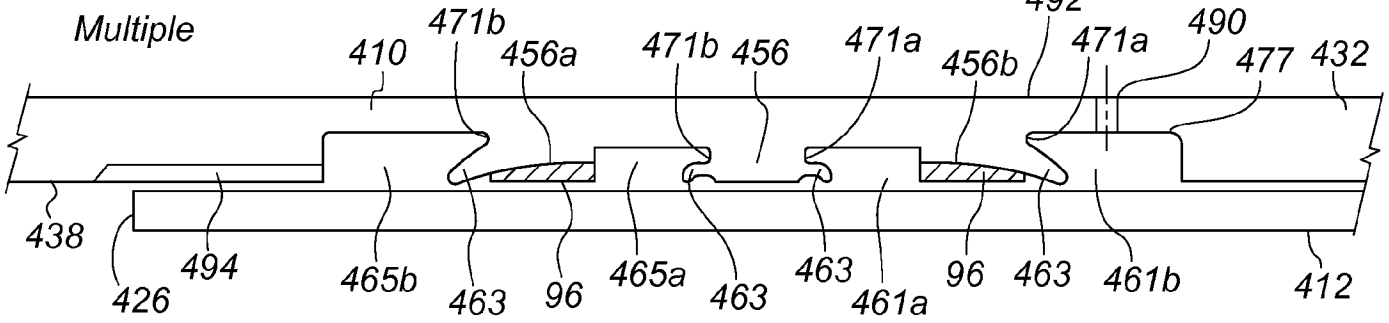
FIG. 16 is a schematic illustration of a sectional side view of a detail of an arrangement for connecting tubular members according to another embodiment of the present invention.

A further embodiment of a connector apparatus 410 is illustrated in FIG. 16. Like parts to those of FIGS. 4 to 10 have been given the same reference numerals with the addition of '400' to aid clarity. In this arrangement there are four grooves 465*a, b*, 461*a, b*. These provide a central rim 456. The grooves 461, 465 all include a single resilient member or lug 463. Lug 463 is described hereinbefore with reference to FIGS. 4-13. Lugs 463 are arranged on opposing side walls 371*b*, 371*a* of the rim 456 located between the grooves 461*a*, 465*a*. Lugs 463 are also arranged on matching side walls of the outer grooves 461*b*, 465*b*. As such the lugs 463 provide multiple uni-directional sealing points along the apparatus 410. As the lugs 463 are unidirectional, if there is a pressure build up between lugs facing the same way the upper lugs flex outwards (burp) to let pressurised fluid out.

Like the embodiment of FIG. 15, groove 461*b* includes a port 490 being an aperture between the base 477 of the groove 461*b* and the outer surface 492 of the second tubular member 432. Groove 465*b* includes a slot 494 along the inner surface 438 connecting the groove 465*b* with the bore above the upper end 426 of the first tubular member 412. Slot 494 provides a bypass channel to allow fluid to exit at the top of the first tubular member 412. An additional feature of this embodiment is the introduction of a slot 96 in the rim 456*a, b* to provide a fluid bypass channel between similarly profiled grooves 465, 461. Unidirectional sealing lugs 463 with bypass slots 96 ensure that the lugs 463 do not inadvertently seal in the opposite direction, leading to hydraulic lock during morphing.

Figure 17:
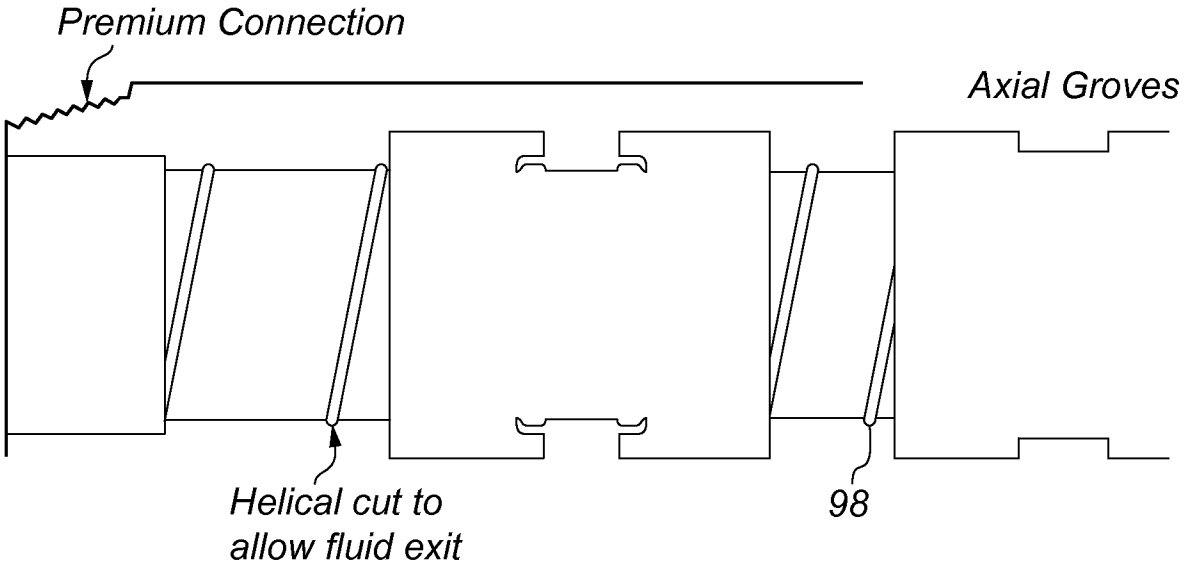
FIG. 17 is a schematic illustration of a sectional side view of a detail of an arrangement for connecting tubular members according to another embodiment of the present invention.

An alternative arrangement to the slots 96 on rims 456 is to provide a helical groove 98 cut into the inner surface 438 of the second tubular member 432 at the connector apparatus 410. This is illustrated in FIG. 17. This provides a fluid exit path between the grooves 461, 465.

The principle advantage of the present invention is that it provides a connection apparatus for joining two tubular members with an improved metal to metal seal between the members.

A further advantage of the present invention is that it provides a connection apparatus for joining two tubular members in which following morphing, a metal to metal seal is retained even when the tubular members relax.

A yet further advantage of at least one embodiment of the present invention is that it provides a connection apparatus for joining two tubular members by morphing into grooves arranged on a member which does not require the use of fluid exclusion means such as syntactic foam.

It will be appreciated by those skilled in the art that modifications may be made to the invention herein described without departing from the scope thereof. For example, when the tubular members have been described as metal structures, only the end portions need to have metal to form the seal and thus the tubular members may be of composite form with metal ends. While integrally formed lug projections may be formed in the milled recesses of the inner surface of the outer tubular, or may be stand alone components inserted into recesses in the outer tubular, it will be appreciated that a combination of these two different lug constructions may be used within a single connector apparatus. In addition, fluid exclusion means may be inserted into recesses with integral milled lug details or inserted into recesses along with lug components. Stud projections may or may not be provided on the upper surface of the projecting lugs of the connector apparatus and although in the illustrated embodiments an arrangement with a single stud projection is shown, the stud projections may be formed as a plurality of discreet point projections which form a circular seal, or may be formed as a curvilinear projection which forms a circular seal. In addition, either one ring of stud projection may be provided or a plurality of circumferential stud projection circles may be arranged on the uppers surface of the lugs to further enhance the seal effect provided.

We claim:

1. A connector apparatus for sealingly connecting to a tubular member in a wellbore, the connector apparatus comprising:

a substantially cylindrical body having a receiving section adapted to receive therein at least one portion of the tubular member for permitting expansion of the at least one portion radially outwardly against one or more circumferential recesses undercut into said substantially cylindrical body and disposed beyond an inner surface of the receiving section of said substantially cylindrical body, each of said one or more circumferential recesses bounded by side walls, said expansion continuing until one or more joints are formed between the at least one portion of the tubular member and the receiving section of said substantially cylindrical body;

wherein, a resilient member protrudes from at least one of the side walls of at least one of said circumferential recesses, said resilient member comprising a lug extending from said at least one of the side walls into said at least one of said recesses, said lug extending substantially parallel to a bore of said substantially cylindrical body and tapering to a distal end, the resilient member being acted on by the at least one portion during expansion and maintaining sealing contact to the at least one portion after expansion.

2. A connector apparatus according to claim 1 wherein the resilient member is entirely contained within the recess.

3. A connector apparatus according to claim 1 wherein there are two resilient members, oppositely arranged across the recess, each protruding from an opposing side wall.

4. A connector apparatus according to claim 1 wherein the resilient member is an annular ring and is coaxial with the circumferentially arranged recess.

5. A connector apparatus according to claim 1 wherein the resilient member has an upper surface and a lower surface, the lower surface facing a base of the recess, and the resilient member includes a spur, located on the upper surface.

6. A connector apparatus according to claim 5 wherein the spur extends circumferentially around the resilient member.

7. A connector apparatus according to claim 1 wherein the resilient member is formed integrally with the receiving section.

8. A connector apparatus according to claim 1 wherein the resilient member is a metal ring located within the recess.

9. A connector apparatus according to claim 8 wherein the metal ring includes a support base, the base having a height substantially the same as the height of the side walls of the recess.

10. A connector apparatus according to claim 1 wherein at least one recess includes two opposing resilient members.

11. A connector apparatus according to claim 1 wherein there are at least one pair of neighbouring recesses with a resilient member on each side wall of the adjoining rim between the recesses.

12. A connector apparatus according to claim 1 wherein a resilient member is located on a common side wall of a plurality of the recesses.

13. A connector apparatus according to claim 1 wherein the resilient member is formed of metal so that a metal to metal seal is formed.

14. A connector apparatus according to claim 1 wherein a fluid exclusion device is located in one or more recesses, the fluid exclusion device comprising a fluid exclusion material, being a crushable medium.

15. A connector apparatus according to claim 1 wherein one or more rims between adjacent recesses include a bypass channel.

16. A connector apparatus according to claim 15 wherein a fluid bypass channel is also located along the inner surface of a distal recess to allow fluid to escape from an end of the connector apparatus.

17. A method of connecting tubular members in a wellbore, the method comprising the steps of:— a) providing a connector apparatus comprising: a substantially cylindrical body having a receiving section adapted to receive therein at least one portion of a tubular member, there being one or more circumferential recesses, bounded by side walls, undercut into said substantially cylindrical body and disposed beyond an inner surface of the receiving section, and a resilient member protruding from at least one of the side walls of at least one of said recesses, said resilient member comprising a lug extending from said at least one of the side walls into said at least one of said recesses, said lug extending substantially parallel to a bore of said substantially cylindrical body and tapering to a distal end;

b) placing the at least one portion within the receiving section of the connector apparatus;

c) expanding the at least one portion radially outwardly against the receiving section until one or more joints are formed between the at least one portion and the receiving section;

d) acting on the resilient member by the at least one portion during expansion; and e) acting on the at least one portion by the resilient member following expansion to maintain sealing contact between the resilient member and the at least one portion after expansion.

18. A method according to claim 17 wherein the method includes the step of using trapped fluid pressure to act upon a lower surface of the resilient member to assist in maintaining sealing contact between the resilient member and the at least one portion after expansion.

19. A method according to claim 17 wherein the method includes the step of providing multiple unidirectional sealing points along the connector apparatus.

20. A method according to claim 17 wherein the method includes the step of directing pressurised fluid out of the at least one recess.

* * * * *